US006467175B2

(12) United States Patent
Böhm-Van Diggelen

(10) Patent No.: US 6,467,175 B2
(45) **Date of Patent: *Oct. 22, 2002**

(54) SPOON

(76) Inventor: Bernd Böhm-Van Diggelen, Tizianstrasse 33, D-90453 Nürnberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/463,310

(22) PCT Filed: Jul. 17, 1998

(86) PCT No.: PCT/DE98/02006

§ 371 (c)(1),
(2), (4) Date: Jan. 24, 2000

(87) PCT Pub. No.: WO99/04674

PCT Pub. Date: Feb. 4, 1999

(65) Prior Publication Data

US 2002/0026715 A1 Mar. 7, 2002

(30) Foreign Application Priority Data

Jul. 22, 1997 (DE) ..... 197 31 429

(51) Int. Cl.[7] ..... A47J 43/28
(52) U.S. Cl. ..... 30/324; 30/345
(58) Field of Search ..... 30/324, 322, 326, 30/345; D7/653

(56) References Cited

U.S. PATENT DOCUMENTS

| | | | | | |
|---|---|---|---|---|---|
| 2,295,847 A | | 9/1942 | Hume | | |
| 2,803,059 A | * | 8/1957 | Murdock et al. | ..... | 30/324 |
| 4,563,816 A | * | 1/1986 | Jagger | ..... | 30/343 |
| 5,075,975 A | * | 12/1991 | Wilson | ..... | 30/324 |
| 5,799,369 A | * | 9/1998 | Schulein | ..... | 30/340 |
| 5,920,993 A | * | 7/1999 | Wenk | ..... | 30/324 |
| 5,940,974 A | * | 8/1999 | Lee | ..... | 30/324 |

FOREIGN PATENT DOCUMENTS

| | | | | | |
|---|---|---|---|---|---|
| DE | 29 05 831 | | 9/1979 | | |
| DE | 296 15 621 | | 3/1998 | | |
| GB | 613224 | * | 7/1965 | ..... | 30/324 |
| NL | 292204 | * | 7/1965 | ..... | 30/324 |

* cited by examiner

*Primary Examiner*—Kenneth E. Peterson
*Assistant Examiner*—Omar Flores Sańchez
(74) *Attorney, Agent, or Firm*—Venable; Gabor J. Kelemen; Chad C. Anderson

(57) ABSTRACT

The invention relates to a spoon for receiving soft or liquid food. Said spoon has a handle with an attached mouthpiece constructed of soft and flexible material. The aim of the invention is to significantly simplify the manner in which food is received by small children and people with facial paralysis. The spoon has a practical shape in that the mouthpiece is trough-shaped and concave and has a level defining upper edge, whereby the thickness of the mouthpiece in the front and on the lateral side is proportional so that its concave shape can be inverted by the pressure of the tongue (Z) during swallowing and the mouthpiece can adapt to the arched shape of the hard palate (G) in a sagital and transversal direction.

13 Claims, 2 Drawing Sheets

Section A

Section A

Section B

SPOON

FIELD OF THE INVENTION

The invention relates to a spoon for receiving soft or liquid food, having a handle and an adjoining mouthpiece, which comprises a soft, flexible material.

BACKGROUND OF THE INVENTION

DE 29 05 831 A 1 discloses a child spoon in which an extended handle supports at one end a bowl comprising a soft, flexible material, with one part of the bowl serving to receive and hold viscous and similar foods; the bowl is extended and flattened in the axial direction, and the part of the bowl that serves to receive and hold foods has a curved surface.

This known child spoon made of a soft material is intended to be better received by children, because they are accustomed to contact with soft objects. Furthermore, this known child spoon is intended to be better adapted to the conformation and movements of a child's mouth, and prevent injuries by the bowl, for example due to bumping against the teeth or lips.

This known spoon has a flat bowl shape that is extended and flat in the axial direction. A mouthpiece of this type, being flat in the transversal direction, and in which the radius of curvature is clearly smaller in the sagittal direction near the palate than the lower radius near the tongue, is structurally suited only for bending the forward spoon edge upward with the tongue. This does not press the food out of the spoon, however. The tongue does not approach the forward hard palate closely enough to trigger the swallowing reflex, so this spoon must be withdrawn from the mouth before the food is swallowed, as is the case for all spoons made of a hard material.

The action of mimic muscles (facial muscles), primarily the orbicularis oris (the annular muscle surrounding the mouth opening), is necessary to keep the food located on the spoon inside the oral cavity. The mouthpiece of the spoon is thus sealed at the transition to the handle. At the same time, the spoon can be pulled out of the oral cavity, with the food remaining in the oral cavity. The swallowing process follows.

For persons whose facial muscles are non-functioning, or have limited functioning, as well as for persons who have not yet learned or are not capable of the motor process of the facial muscles for the above-described intake of food, eating with the known spoons is impossible, or difficult and lengthy, even with the assistance of another person.

Persons who fit this category include:

- infants whose sole nourishment thus far has been from breast- or bottle-feeding;
- persons experiencing facial paralysis following an accident or stroke; and
- persons with other facial paralysis, for example due to illness, or limited facial function.

SUMMARY OF THE INVENTION

It is the object of the invention to modify a spoon of the type mentioned at the outset such that food intake is greatly facilitated, or even becomes practical, for the persons listed above.

This object is accomplished according to claim 1 in that the mouthpiece is trough-shaped and concave and has a upper limiting edge, which lies in one plane, with the material thickness of the mouthpiece in the forward and lateral regions being selected such that its concave shape is converted into a convex shape by the pressure of the tongue during the swallowing process, and the mouthpiece can be adapted in the sagittal and transversal directions to the curved shape of the hard palate.

To permit a simple and inexpensive production of the spoon, a modification of the invention provides that the mouthpiece and the handle are produced in one piece.

For proper functioning of the spoon, in accordance with a further embodiment of the invention, it is provided that the mouthpiece comprises a material, for example elastomer, preferably having a Shore hardness in a range of 60 to 80.

The advantages attained with the invention are, notably, that the eating process is facilitated, or even becomes practical, for the persons mentioned above, because the swallowing process can take place while the spoon remains in the mouth. The use of a material having a Shore hardness in a range of 60 to 80 assures the material thickness and minimum rigidity of the spoon mouthpiece that are necessary for proper functioning, on the one hand, and, on the other hand, a sufficient stability for the handle design in order to take into consideration all physiological and physical forces that may occur. It is therefore also possible to produce the entire spoon in one piece.

BRIEF DESCRIPTION OF THE DRAWINGS

An embodiment of the invention is illustrated in the drawing and described in detail below.

Shown are in.

DESCRIPTION OF THE PREFERRED EMBODIMENT

Figure 1:
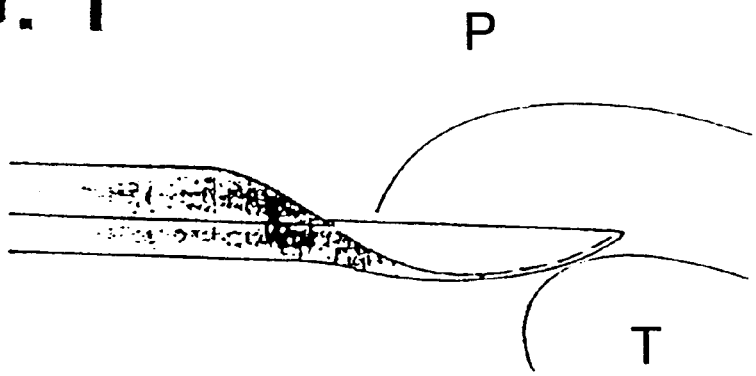
FIG. 1 a longitudinal section of a spoon according to the invention, in the non-stressed state.

FIG. 1 shows a spoon that is inserted into an oral cavity, with the concave mouthpiece carrying food. FIG. 1 also shows the palate P and the tongue T, which is initially only touching the mouthpiece.

Figure 2:
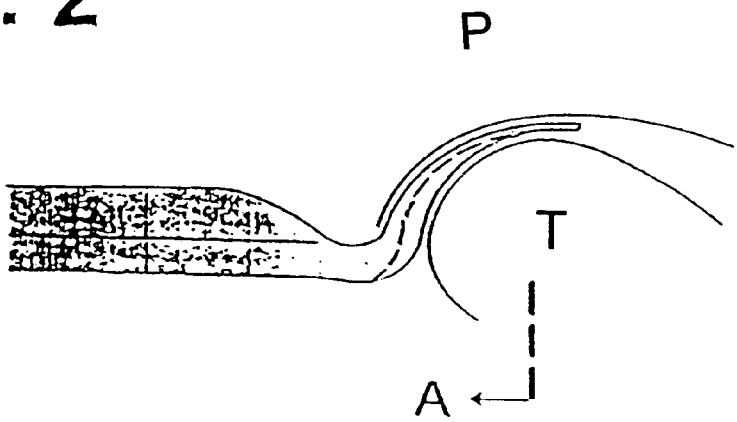
FIG. 2 a longitudinal section of the spoon during the swallowing process.

FIG. 2 shows the position of the tongue T during the swallowing process, during which the tongue presses the mouthpiece of the spoon located in the oral cavity flat against the palate P, thereby pressing the food laterally out of the spoon. The tongue converts the trough-shaped, concave mouthpiece into a convex one. In this position, in which the tongue T approaches the forward hard palate P, the swallowing reflex can be triggered. No cooperation with mimic muscles, particularly the orbicularis oris (the annular muscle around the mouth opening), is necessary for keeping the food on the spoon located in the mouth. The spoon is not removed from the mouth until the swallowing reflex is complete, and no more food is on the spoon.

Figure 3:
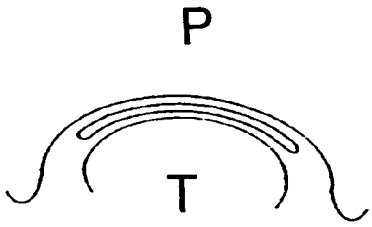
FIG. 3 a cross-section of a spoon according to FIG. 2, along the line A.

FIG. 3 is a cross-sectional representation of how the tongue T presses the spoon against the palate P, and how the mouthpiece is congruently adapted to the curvature of the palate P in the sagittal and transversal directions. In this state, the tongue T approaches the palate P up to the thickness of the spoon, so the swallowing reflex can be triggered.

FIGS. 4 through 8 show the precise dimensions of the spoon according to the invention, as it is already being mass-produced and used with tremendous success.

Figure 4:
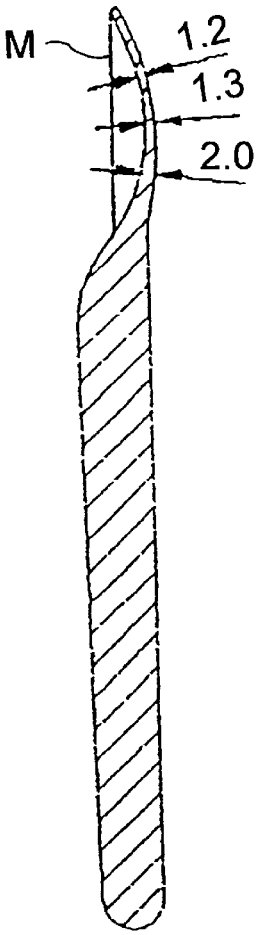
FIG. 4 a longitudinal section of a functional sample of a spoon according to the invention, with a list of dimensions.
Figure 5:
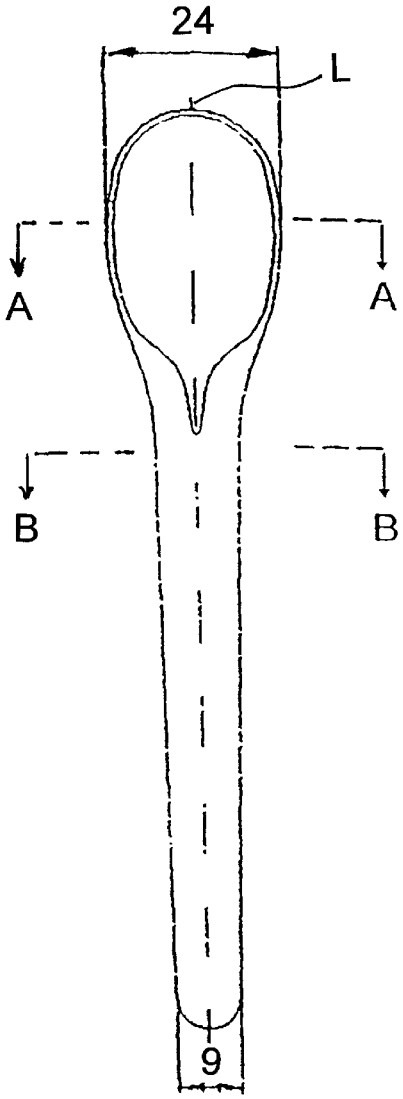
FIG. 5 a plan view of the sample according to FIG. 4, with a list of dimensions.
Figure 6:
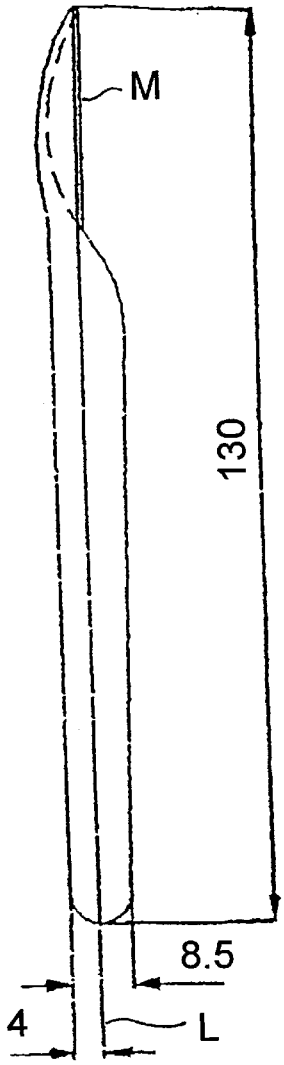
FIG. 6 a further longitudinal section of the sample, also with a list of dimensions.
Figure 7:
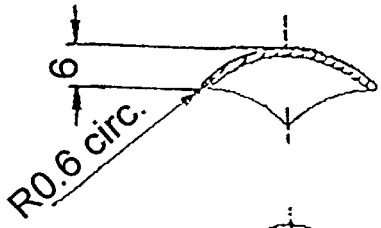
FIG. 7 a cross-section of a spoon according to FIG. 5, along the line A.
Figure 8:
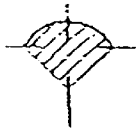
FIG. 8 a cross-section of a spoon according to FIG. 5, along the line B.

FIG. 4 shows the limiting edge M of the mouthpiece. FIG. 5 shows the longitudinal axis L of the handle. As shown in FIG. 6, the limiting M of the mouthpiece and the longitudinal axis M of the handle lie in substantially the same plane.

As may be observed in FIGS. 4, 5 and 6, the handle has a diametral dimension which increases from the free handle end toward the mouthpiece.

What is claimed is:

1. A spoon for receiving and for delivering a liquid of soft food to a person, said spoon allowing the person to discharge the liquid or soft food from the spoon with his or her tongue and to bring his or her tongue into sufficiently close proximity to his or her plate to trigger a swallowing reflex so that he or she can swallow the liquid or soft food without withdrawing the spoon from his or her mouth, said spoon comprising in combination:

a handle and an adjoining through-shaped concave mouthpiece, which mouthpiece is comprised of a soft, flexible material, with the material thickness of the mouthpiece decreasing in a direction from said handle toward the tip of said mouthpiece;

said mouthpiece being converted from its concave shape to a convex shape by the pressure of the tongue, so that said mouthpiece conforms to the person's palate sufficiently that the pressure of the tongue against the mouthpiece triggers the swallowing reflex.

2. The spoon according to claim 1, wherein the largest width of the mouthpiece measures about 24 mm.

3. The spoon according to claim 1, wherein the mouthpiece is an elastomer.

4. The spoon according to claim 1, wherein a largest width of said mouthpiece is approximately four times a greatest height of said mouthpiece.

5. The spoon according to claim 1, wherein said material has a Shore hardness of about 60 to 80.

6. The spoon according to claim 1, wherein the material thickness of the mouthpiece decreases from about 2 mm adjacent said handle to about 1.3 mm in a mouthpiece center and to about 1.2 mm in a forward third of said mouthpiece.

7. The spoon according to claim 1, wherein said handle and said mouthpiece form a unitary, one-piece structure.

8. The spoon according to claim 1, wherein said handle has a diametral dimension increasing toward said mouthpiece.

9. A spoon for receiving and for delivering a liquid or soft food to a person, said spoon comprising a) a handle having a longitudinal axis and opposite first and second ends; said handle having a diametral dimension increasing from said first end to said second end;

b) a trough-shaped, upwardly concave mouthpiece adjoining said second end of said handle; the mouthpiece having an outer tip and an upper limiting edge defining a plane; and c) means for providing for a conversion of said mouthpiece from an upwardly concave shape to an upwardly convex shape by pressure of the person's tongue, whereby said mouthpiece generally conforms to the person's palate in a sagittal and transversal direction thereof; said means including in combination:

(1) a relationship between said axis and said plane; said relationship being such that said axis lies in said plane;

(2) a soft, flexible material forming said mouthpiece;

(3) a material thickness of said mouthpiece decreasing in a direction from said handle toward said tip; and (4) a largest width of said mouthpiece being approximately four times a greatest height of said mouthpiece.

10. The spoon according to claim 9, wherein said material has a Shore hardness of about 60 to 80.

11. The spoon according to claim 9, wherein the material thickness of the mouthpiece decreases from about 2 mm adjacent said handle to about 1.3 mm in a mouthpiece center and to about 1.2 mm in a forward third of said mouthpiece.

12. The spoon according to claim 9, wherein said handle and said mouthpiece form a unitary, one-piece structure.

13. The spoon according to claim 9, wherein said mouthpiece is an elastomer.

* * * * *